US007459999B2

(12) United States Patent
Burkhardt et al.

(10) Patent No.: US 7,459,999 B2
(45) Date of Patent: Dec. 2, 2008

(54) VARIABLE-DIAMETER ELECTROMAGNETIC COIL

(75) Inventors: Gary Lane Burkhardt, Adkins, TX (US); Albert Joseph Parvin, Jr., San Antonio, TX (US); Todd Hegert Goyen, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 42 days.

(21) Appl. No.: 11/767,974

(22) Filed: Jun. 25, 2007

(65) Prior Publication Data

US 2008/0012673 A1 Jan. 17, 2008

Related U.S. Application Data

(60) Provisional application No. 60/805,669, filed on Jun. 23, 2006, provisional application No. 60/805,697, filed on Jun. 23, 2006.

(51) Int. Cl.
*H01F 27/30* (2006.01)

(52) U.S. Cl. ..... 336/198

(58) Field of Classification Search ..... 336/65, 336/115–116, 198; 335/229–251
See application file for complete search history.

(56) References Cited

U.S. PATENT DOCUMENTS 6,481,092 B2 * 11/2002 Buttrick et al. ..... 29/602.1
2008/0042646 A1 * 2/2008 Burkhardt et al. ..... 324/240

FOREIGN PATENT DOCUMENTS

EP 852421 A1 * 7/1998

* cited by examiner

*Primary Examiner*—Tuyen T. Nguyen
(74) *Attorney, Agent, or Firm*—Grossman, Tucker et al.

(57) ABSTRACT

The present disclosure relates to a variable diameter electromagnetic coil. The coil may include a coil winding containing inner and outer winding layers. The coil may incorporate a first hub including one or a plurality of inner supports, one of the inner supports connected to a location on the inner winding layer. A second hub may then be provided including one or a plurality of outer supports, one of the outer supports connected to a location on the outer winding layer. One of the first or second hubs may be capable of rotating to cause the coil winding to wind or unwind. An interconnect hub may then be provided which may be capable of providing electrical connection to the coil winding.

20 Claims, 6 Drawing Sheets

100

200

1

VARIABLE-DIAMETER ELECTROMAGNETIC COIL

CROSS-REFERENCE TO RELATED APPLICATIONS

This application claims the benefit of U.S. Provisional Applications 60/805,669 and 60/805,697, both filed Jun. 23, 2006 whose teachings are incorporated herein by reference in their entirety.

STATEMENT REGARDING FEDERALLY SPONSORED RESEARCH OR DEVELOPMENT

This invention was made with United States Government support under Government Contract No. DTRS 56-02-T-0001 awarded by the U.S. Department of Transportation. The Government has certain rights in this invention.

FIELD OF THE INVENTION

This disclosure pertains to variable diameter electromagnetic coils that may be used for generating electromagnetic fields.

BACKGROUND

Electromagnetic coils are used in numerous applications to generate alternating or static magnetic fields. In most applications, it may be sufficient for the coils to be of a fixed diameter. Fixed diameter coils may therefore be used, e.g., in a variety of applications that require a magnetic field, such as solenoid actuators, conventional electrical motors, transformers, etc. One example of what is termed a collapsible coil for inspection of pipelines is described in U.S. Pat. No. 7,154,264. As discussed therein, a collapsible excitation coil includes a plurality of electrically interconnected collapsible excitation coil segments connected to a first end of what is described as an inspection pig structure along with inspection of pipelines that have obstructions which were said to prevent conventional inspection pigs from passing the obstructions.

SUMMARY

In one exemplary embodiment, the present disclosure relates to an electromagnetic coil. The coil may include a coil winding containing inner and outer winding layers wherein the coil is wound in a first direction. The coil may incorporate a first hub including one or a plurality of inner supports, one of the inner supports connected to a location on the inner winding layer. A second hub may then be provided including one or a plurality of outer supports, one of the outer supports connected to a location on the outer winding layer. One of the first or second hubs may be capable of rotating to cause the coil winding to wind or unwind. An interconnect hub may then be provided that may be capable of providing electrical connection to the coil winding.

In a second exemplary embodiment, the present disclosure again relates to an electromagnetic coil. The coil may again include a coil winding containing inner and outer winding layers wherein the coil is wound in a first direction. A first hub may then be supplied including one or a plurality of inner supports, one of the inner supports connected to a location on the inner winding layer which inner support is capable of extending or retracting in a radial direction. A second hub may then be supplied including one or a plurality of outer supports, one of the outer supports connected to a location on the outer winding layer which outer support is also capable of extending or retracting in a radial direction. One of the first or second hubs is capable of rotating to cause the coil winding to wind or unwind. An inner interconnect cable and an outer interconnect cable may then be supplied, both attached to the coil winding and to an interconnect hub wherein one of the inner or outer interconnect cables is capable of winding about the interconnect hub in a second direction that is either equal to or opposite to the coil winding first direction.

In a third exemplary embodiment, the present disclosure relates to a method for manufacturing a variable diameter electromagnetic coil. The method includes forming a coil winding containing inner and outer winding layers wherein the coil is wound in a first direction. This may then be followed by positioning a first hub including one or a plurality of inner supports within the coil winding, one of the inner supports connected to a location on the inner winding layer. This may then be followed by positioning a second hub within the coil including one or a plurality of outer supports, one of the outer supports connected to a location on the outer winding layer. One of the first or second hubs is also capable of rotating to cause the coil winding to wind or unwind. This may then be followed by attachment of an inner interconnect cable and an outer interconnect cable to the coil winding and to an interconnect hub wherein one of the inner or outer interconnect cables is capable of winding about the interconnect hub.

BRIEF DESCRIPTION OF THE DRAWINGS

The detailed description below may be better understood with reference to the accompanying figures which are provided for illustrative purposes and are not to be considered as limiting any aspect of the invention.

DETAILED DESCRIPTION

Figure 1A:
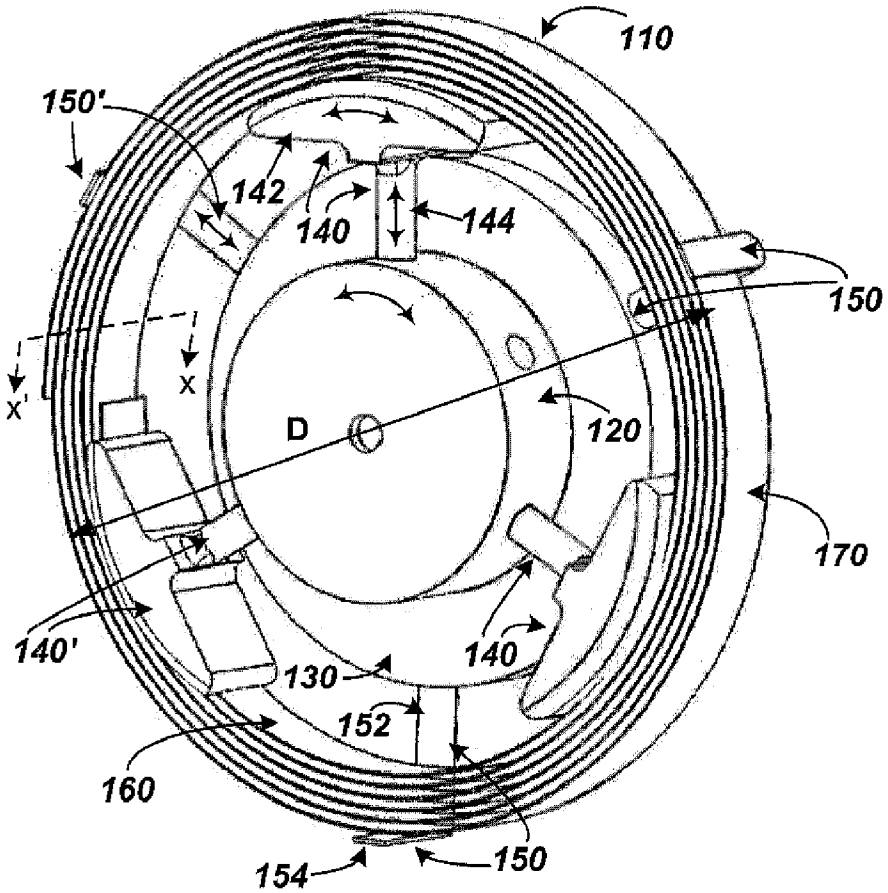
FIG. 1A depicts an exemplary variable diameter coil at a first diameter.

Attention is directed to FIG. 1A which illustrates an exemplary embodiment of a variable diameter electromagnetic coil 100 at a first diameter. The coil 100 may include a coil winding 110 and a first hub 120 that may include one or a plurality of inner supports 140. The inner supports 140 may include a head portion 142 that may provide a curved surface portion that may contact and accommodate all or a portion of the curvature of an inner winding layer 160. The inner supports may include a shaft 144, one end of which may be engaged to the first hub 120 and the other end of which may be pivotably engaged to the head portion 142.

The coil 100 may further include a second hub 130 that may include one or a plurality of outer supports 150 which may also include a shaft 152 and head portion 154. A first hub may therefore be understood as any structure which may accommodate an inner support and a second hub may be understood as any structure that may accommodate an outer support. The coil diameter D may be adjusted by winding and/or unwinding the coil winding 110. This may allow the coil 100 to have a continuously variable diameter D over a wide range and may allow the coil 100 to function electromagnetically at any diameter within the range.

Winding or unwinding the coil winding 110 may be accomplished by rotating the first hub 120. An inner support 140', which may be connected to the first hub 120, may also be connected to a location on an inner winding layer 160. An inner support may therefore be understood as any structure which supports the inner winding layer. An outer support 150', which may be connected to the second hub 130, may also be connected to a location on an outer winding layer 170. An outer support may therefore be understood as any structure which may support an outer winding layer.

The inner supports 140 and the outer supports 150 may each be configured to extend and retract in the radial direction as the first hub 120 may be rotated. The inner supports 140 may also be configured to rotate along with the first hub 120. The outer support 150' that may be connected to a location on the outer winding layer 170 may be configured to fix the outer winding layer 170. The supports 140, 150 may be configured to extend or retract in proportion to the rotation of the first hub 120. Winding the coil winding 110 may be accomplished by rotating the first hub 120 in the clockwise direction, in the sense of FIG. 1A. Unwinding the coil winding 110 may be accomplished by rotating the first hub 120 in the counterclockwise direction, again in the sense of FIG. 1A. Winding the coil winding 110 may then reduce the coil diameter D and unwinding the coil winding 110 may increase the coil diameter D.

Figure 1B:
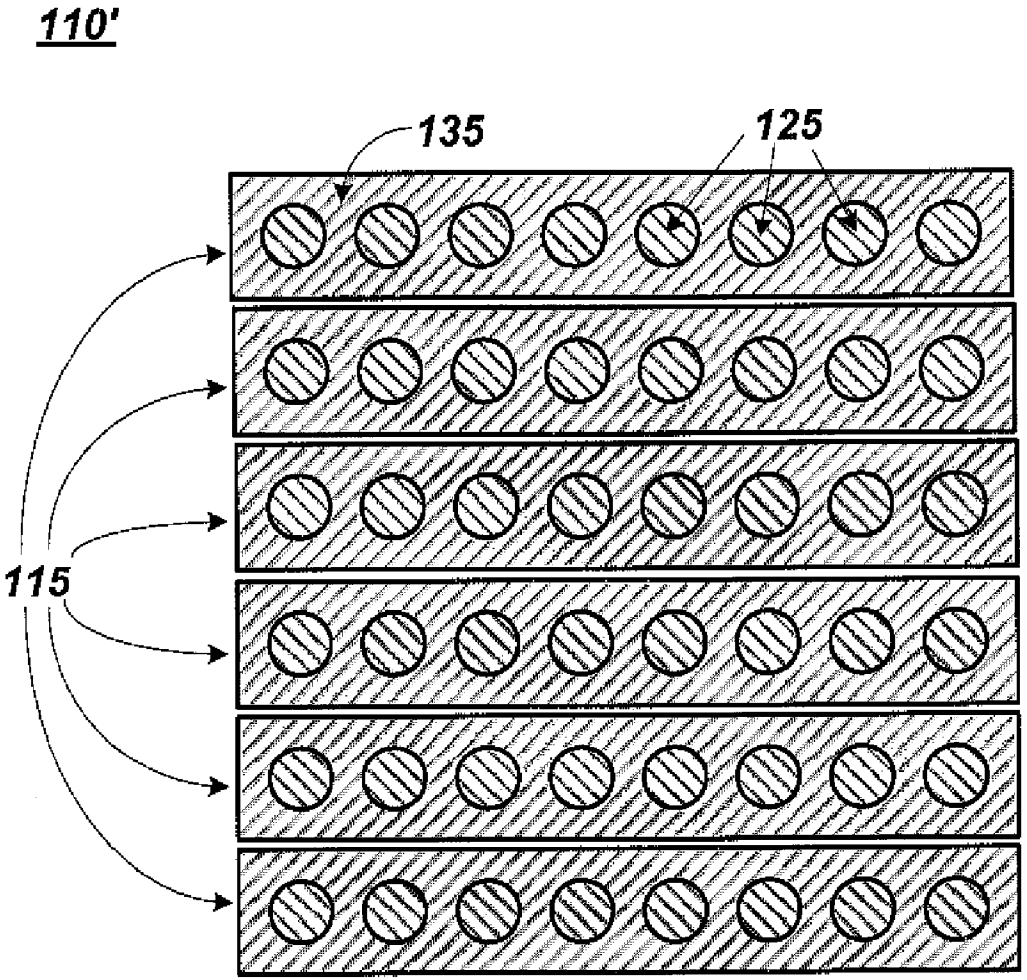
FIG. 1B depicts a cross-section of an exemplary variable diameter coil winding illustrating a configuration of substantially parallel conductors and insulation.

Attention is directed to FIG. 1B which illustrates an exemplary cross section 110' of a coil winding 110 showing conductors 125 and insulation 135 that may be arranged in layers 115 of the coil winding 110. The coil winding 110 may be formed of one or a plurality of conductors 125. The conductors 125 may be spaced by insulating material 135. The conductors may be joined as illustrated and may be in a substantially parallel configuration. It may be appreciated that the number of conductors 125 and number of layers 115 may be varied. A coil winding 110 may therefore be understood as one or a plurality of layers 115. A layer 115 may be understood to mean all or a portion of a revolution of one or a plurality of joined conductors 125, separated and/or surrounded by insulation 135. A conductor may be understood to mean a wire or other structure constructed of a material having a resistivity value less than about $10^{-4}$ ohm-centimeters at 20° C. It may be appreciated that winding a coil winding 110 may increase the number of layers 115 while unwinding may decrease the number of layers 115.

As noted, the conductors 125 may be separated by, and may be surrounded by, a region of insulating material 135. Insulating material may be understood to mean material with a resistivity value exceeding about $10^{10}$ ohm-centimeters at 20° C. The conductor material and insulating material may provide a compliant-like characteristic when wound that may allow the coil winding 110 to expand or contract.

Figure 2:
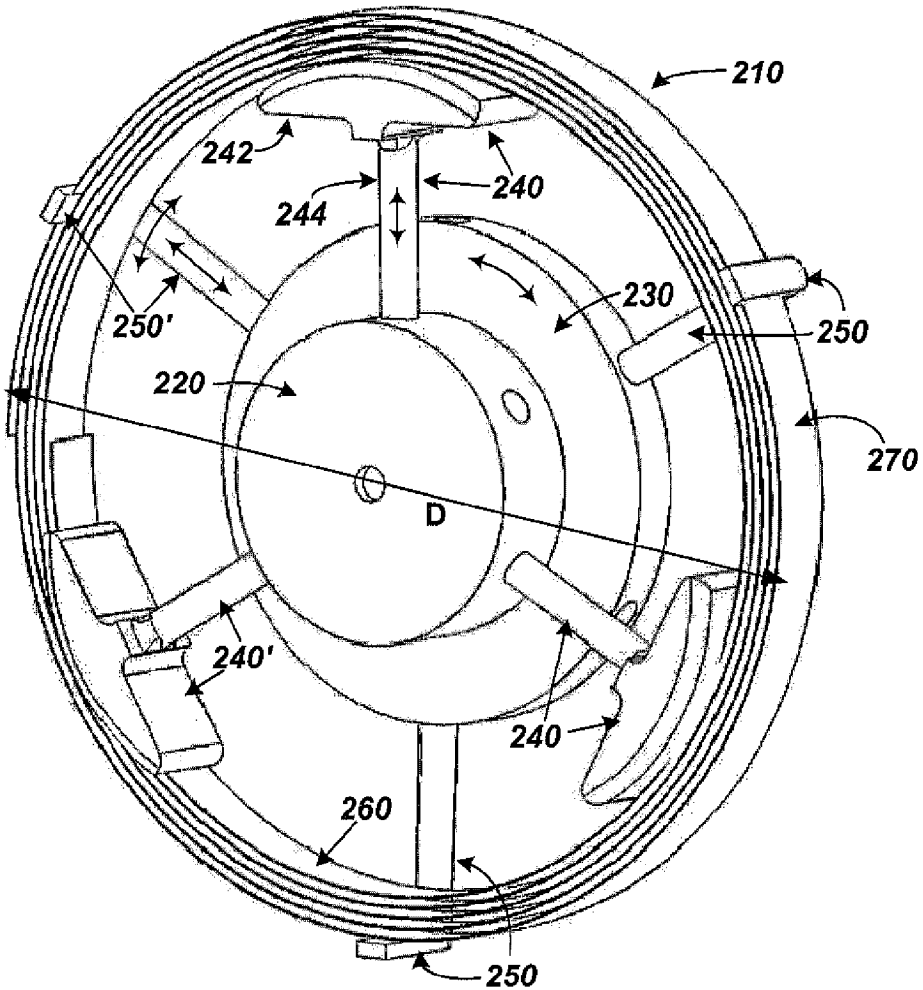
FIG. 2 depicts an exemplary variable diameter coil at a second diameter.

Attention is directed to FIG. 2 which illustrates in exemplary embodiment of a variable diameter electromagnetic coil 200 at a second (e.g., increased) diameter. The coil 200 may again include a coil winding 210, a first hub 220, a second hub 230, one or a plurality of inner supports 240, and one or a plurality of outer supports 250. The coil diameter D may again be adjusted by winding and/or unwinding the coil winding 210. As noted above, the first hub 220 may rotate and the second hub 230 may be fixed, to provide winding and unwinding of the coil 210. In addition, it may now be appreciated that the coil 200 may also be configured so that the first hub 220 may be fixed and the second hub 230 may rotate. In this configuration, at least one of the inner supports (e.g., 240') may be fixed to a location on the coil inner winding layer 260 and the outer supports 250 may rotate with the second hub 230. An outer support 250' may then be connected to a location on the outer winding layer 270. The inner supports 240 (which include shaft 244 and head portion 242) and the outer supports 250, may be configured to extend and retract in the radial direction as the second hub 230 may be rotated. The outer supports 250 may also rotate along with the second hub 230. At least one of the inner supports (e.g., 240') may be connected to a location on the inner winding layer 260 to fix the inner winding layer 260 at such location. The supports 240, 250 may be configured to extend or retract in proportion to the rotation of the second hub 220. Winding the coil winding 210 may be accomplished by rotating the second hub 230 in the counterclockwise direction, in the sense of FIG. 2. Unwinding the coil winding 210 may be accomplished by rotating the second hub 230 in the clockwise direction, in the sense of FIG. 2.

Figure 3:
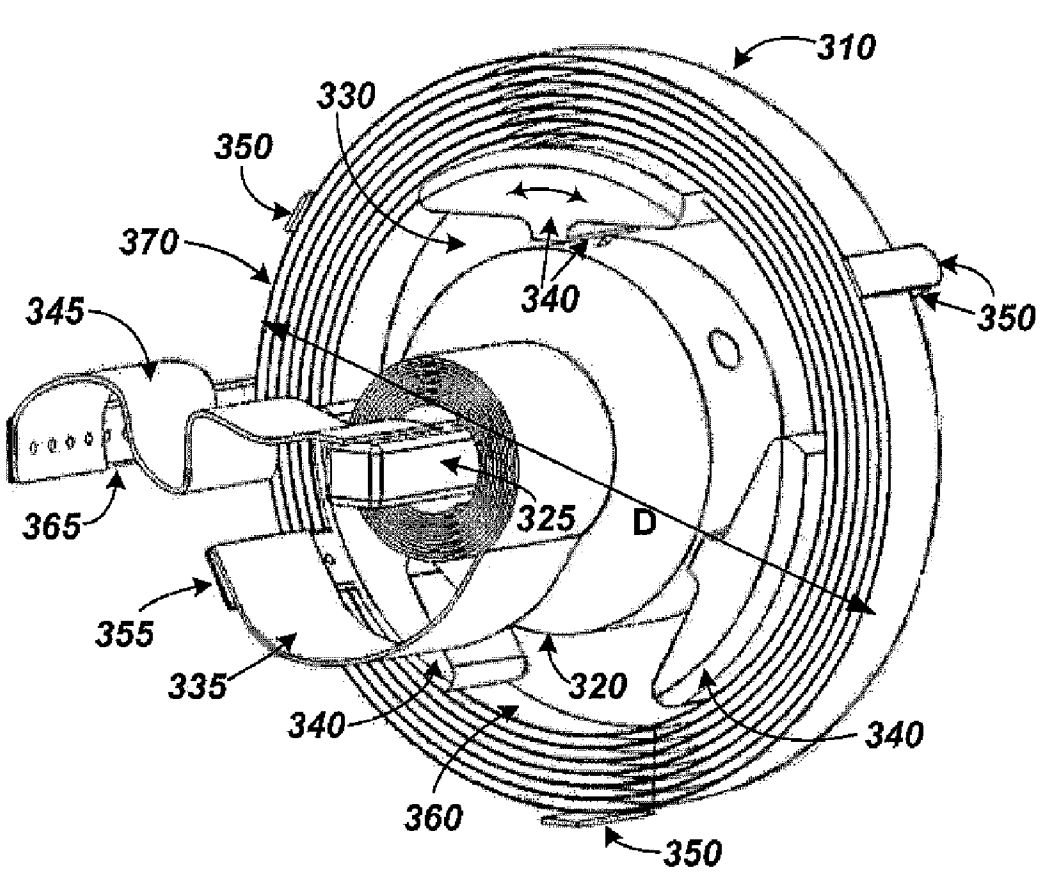
FIG. 3 depicts an exemplary variable diameter coil at a first (e.g., decreased) diameter including exemplary electrical connections to the coil winding.
Figure 4:
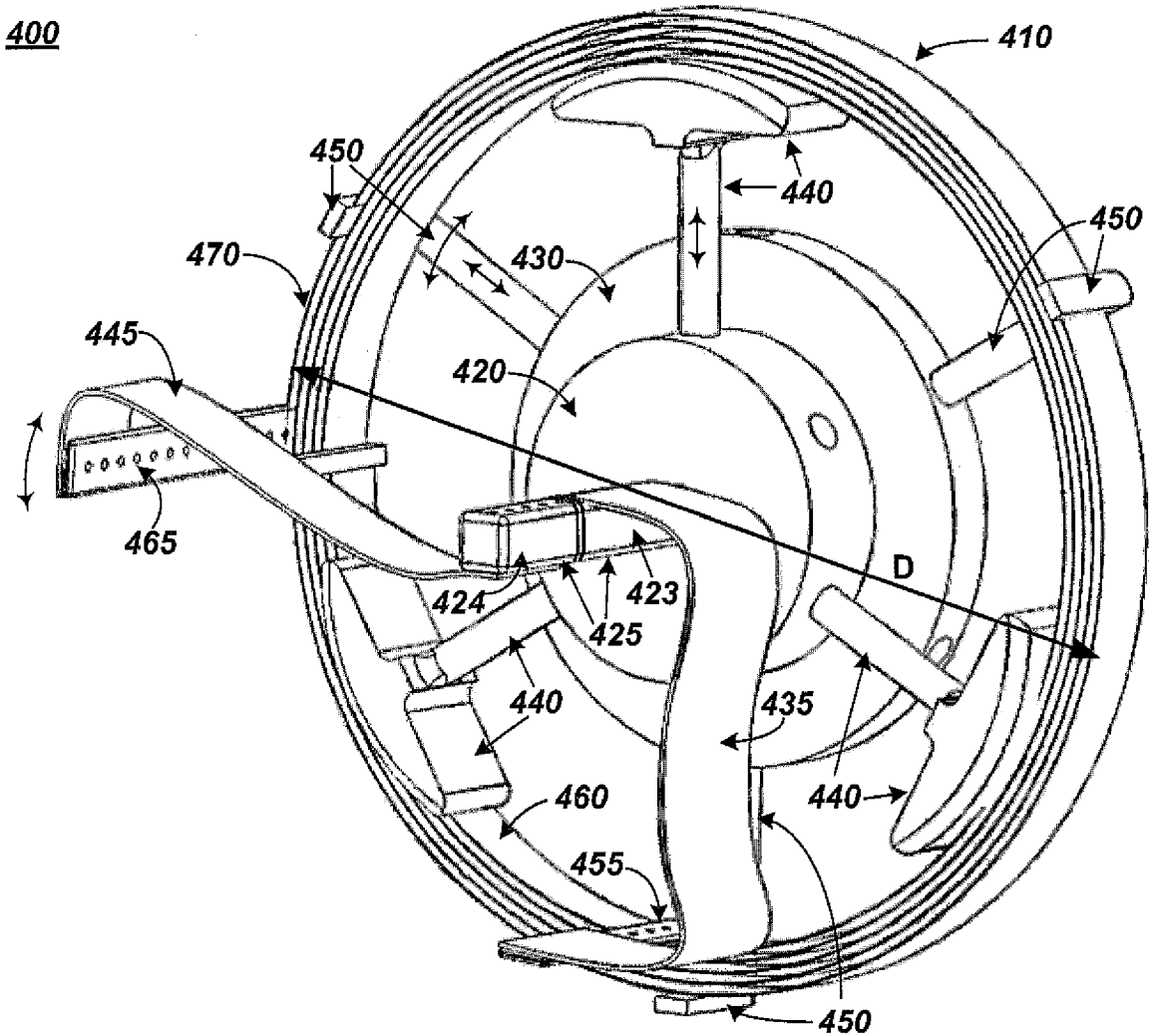
FIG. 4 depicts an exemplary variable diameter coil at a second (e.g., increased) diameter including exemplary electrical connections to the coil winding.

Attention is directed to FIGS. 3 and 4 which depict exemplary embodiments of variable diameter electromagnetic coils 300, 400 at a first (e.g., decreased) and a second (e.g., increased) diameter, respectively. Similar to the coils disclosed above, the variable diameter coils shown in FIGS. 3 and 4, may include a coil winding 310, 410, a first hub 320, 420, a second hub 330, 430, inner supports 340, 440, and outer supports 350, 450. The coil winding 310, 410 may also include an inner winding layer 360, 460 and an outer winding layer 370, 470.

As shown in FIG. 3, the coil 300 may also include an interconnect hub 325, an inner interconnect cable 335, and an outer interconnect cable 345. The inner interconnect cable 335 may be connected to the interconnect hub 325. The inner interconnect cable 335 may also be connected to an inner connector 355 that may be connected to an end of the inner winding layer 360. Similarly, the outer interconnect cable 345 may be connected to the interconnect hub 325. The outer interconnect cable 345 may also be connected to an outer connector 365 that may be connected to an end of the outer winding layer 370. The interconnect hub 325 may provide for electrical connections between the electromagnetic coil 300 and an external power supply (not shown). In this manner, power may be supplied to the electromagnetic coil winding 310 that may cause current to flow in the coil winding 310. Current flowing in the coil winding 310 may then produce a magnetic field. The supplied power may be AC or DC. An electromagnetic coil that may be supplied by an AC power source may be used as part of a system for testing pipe wall integrity that may rely on remote field eddy currents. An example of such is supplied in U.S. Appl. 60/805,697, whose teachings are incorporated by reference.

It may be appreciated that the variable diameter electromagnetic coil 300 may be energized at any diameter D within a range of diameters. Thus, the coil 300 may function electromagnetically at any diameter D within this range.

The diameter D of the coil 300 may be increased by unwinding the coil winding 310 and may be decreased by winding the coil winding 310. Winding or unwinding the coil winding 310 may be accomplished once again according to the description above with respect to FIG. 1A.

The interconnect hub 325 itself may not rotate. The inner interconnect cable 335 may be wound about the interconnect hub 325 as the coil winding 310 may be wound. The inner interconnect cable 335 may be unwound as the coil winding 310 may be unwound. In order to achieve such coordinated winding and unwinding of the coil winding 310 along with the inner interconnect cable 335, at initial assembly, the coil winding 310 may be wound about the inner supports 340 in the counterclockwise direction. Also at initial assembly, the inner interconnect cable 335 may be wound about the interconnect hub 325 in the clockwise direction. In addition, it may be appreciated that the coil winding 310 may be wound about the inner supports 340 in a clockwise direction and the inner interconnect cable 335 may be wound about the interconnect hub 325 in the counterclockwise direction. It may also be appreciated that the outer interconnect cable 345 may itself not wind about the interconnect hub 325. An end of the outer interconnect cable 345 may be connected to the outer connector 365 and may extend or retract as the coil winding 310 may be unwound or wound.

Attention is directed to FIG. 4 which illustrates an exemplary embodiment of a variable diameter coil 400 at an increased diameter. As shown in FIG. 4, the coil 400 may also include an interconnect hub 425, an inner interconnect cable 435, and an outer interconnect cable 445. The interconnect hub 425 may include a first portion 423 and a second portion 424. The first portion 423 and the second portion 424 may be capable of rotating relative to one another. More specifically, the interconnect hub 425 may provide the ability to form an electrical connection through such rotating assembly. Such electrical connection may include connection between an end of the inner coil winding layer 460 and an end of the outer coil winding layer 470. It may also provide electrical connection to a power source (not shown for clarity). More specifically, the interconnect hub may include what is known as a slip ring which may include a conductive circle or band mounted on a shaft and appropriately insulated. It may be appreciated that in the case of such an interconnect hub, either the inner or outer interconnect cable may avoid the need to wind onto the interconnect hub when varying the coil diameter.

The inner interconnect cable 435 may be connected to the interconnect hub 425, e.g. the first portion 423. The inner interconnect cable 435 may also be connected to an inner connector 455 that may be connected to an end of the inner winding layer 460. Similarly, the outer interconnect cable 445 may be connected to the interconnect hub 425, e.g. the second portion 424. The outer interconnect cable 445 may also be connected to an outer connector 465 that may be connected to an end of the outer winding layer 470. The interconnect hub 425 may provide for electrical connections between the electromagnetic coil 400 and an external power supply (not shown). In this manner, power may be supplied to the electromagnetic coil winding 410 that may cause current to flow in the coil winding 410. Current flowing in the coil winding 410 may then produce a magnetic field. In addition, the diameter D of the coil 400 may be increased or decreased according to the discussion above with respect to FIG. 2.

FIG. 4 also illustrates that situation wherein, unlike FIG. 3, the outer interconnect cable 445 may be wound about the interconnect hub 425 (which again may not rotate) as the coil winding 410 may be wound. The outer interconnect cable 445 may then be unwound as the coil winding 410 may be unwound. In order to achieve such coordinated winding and unwinding of the coil winding 410 and the outer interconnect cable 445, at initial assembly, the coil winding 410 may be wound about the inner supports 440 in the counterclockwise direction. Likewise, also at initial assembly, the outer interconnect cable 445 may also be wound about the interconnect hub 425 in the counterclockwise direction. In addition, it may be appreciated that the coil winding 410 may be wound about the inner support 440 in the clockwise direction and the outer interconnect cable 445 may be wound about the interconnect hub 425 in the clockwise direction. As may also be appreciated, the inner interconnect cable 435 may not wind about the interconnect hub 325. An end of the inner interconnect cable 435 may be connected to the inner connector 455 and may extend or retract as the coil winding 410 may be unwound or wound.

Figure 5A:
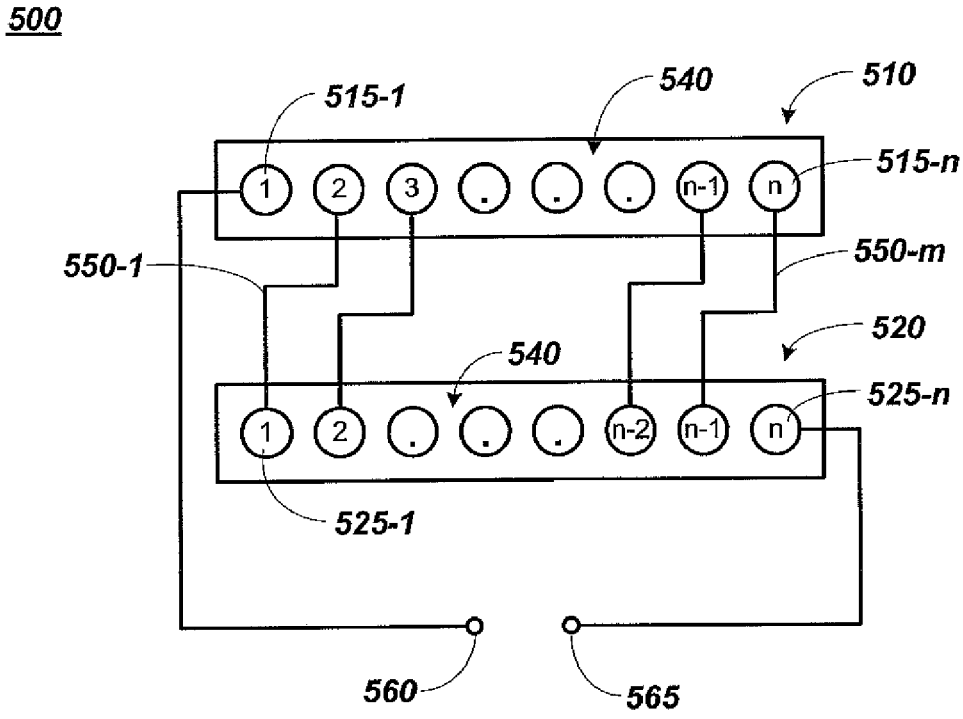
FIGS. 5A and 5B depict exemplary coil conductor interconnecting wiring configurations in a series arrangement and a parallel arrangement, respectively.
Figure 5B:
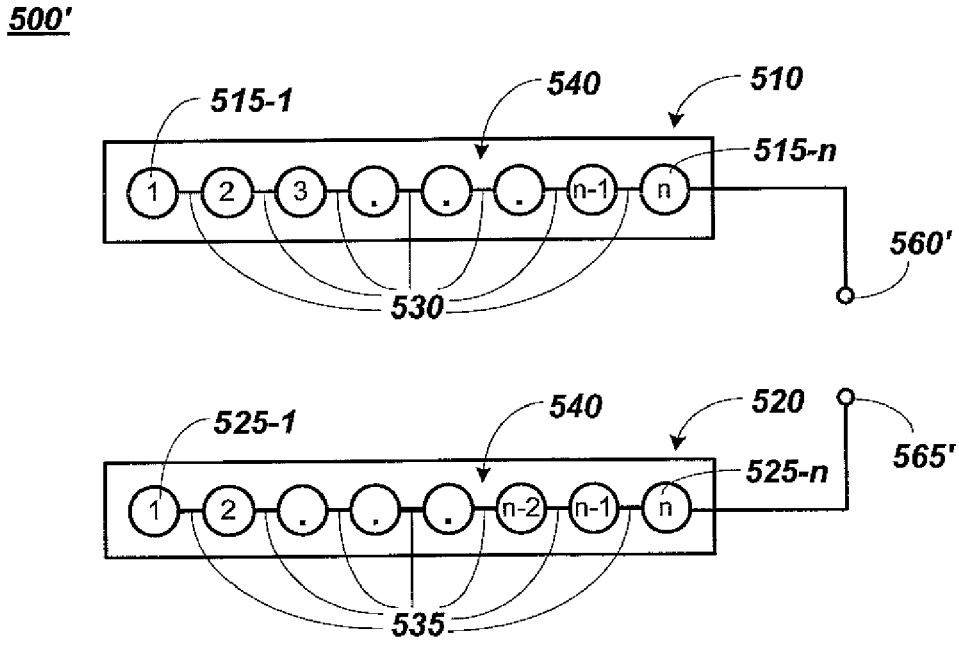

Attention is directed to FIGS. 5A and 5B which illustrate two exemplary electrical interconnection configurations 500, 500' for a coil winding. FIGS. 5A and 5B depict only a first end 510 and a second end 520 of a coil winding and electrical interconnections 550, 530, 535 for clarity. As discussed above, a coil winding may include one or a plurality of conductors 1 through n. The coil winding may be configured similar to ribbon cable, meaning the conductors 1 through n may be substantially parallel and may be separated and/or surrounded by an insulating material 540.

FIG. 5A shows what may be termed series type interconnections 550. The coil winding includes one or a plurality of conductors 1 through n separated and/or surrounded by an insulating material 540. For a series interconnection configuration 500, a first end 515-1 of a first conductor 1 may be configured to be connected to a first port 560 of a power source (not shown). A second end 525-1 of the first conductor 1 may be connected to a first end 515-2 of a second conductor 2 by interconnection 550-1. A second end 525-2 of the second conductor 2 may be connected to a first end 515-3 of a third conductor 3 by interconnection 550-2. These connections may be continued for n conductors and m interconnections. Interconnection m may be between a first end **515-*n* of conductor n and a second end 525-(n-1) of conductor n-1. A second end 525-*n* of the conductor n may be configured to be connected to a second port 565** of a power source (not shown).

FIG. 5B shows parallel type interconnections 530, 535. The coil winding includes one or a plurality of conductors 1 through n separated and/or surrounded by an insulating material 540. The first ends 515-1 through **515-*n* of each conductor may be connected together by one or a plurality of interconnections 530. The second ends 525-1 through 525-*n* may be connected together by one or a plurality of interconnections 535. Interconnection 530 may also be connected to a first port 560' of a power supply (not shown) and interconnection 535 may likewise be connected to a second port 565'** of the power supply.

Although illustrative embodiments and methods have been shown and described, a wide range of modifications, changes, and substitutions is contemplated in the foregoing disclosure and in some instances some features of the embodiments or steps of the method may be employed without a corresponding use of other features or steps. Accordingly, it is appropriate that the claims be construed broadly and in a manner consistent with the scope of the embodiments disclosed herein.

What is claimed is:

1. An electromagnetic coil comprising:

a coil winding containing inner and outer winding layers wherein said coil winding is wound in a first direction;

a first hub including one or a plurality of inner supports, one of said inner supports connected to a location on said inner winding layer;

a second hub including one or a plurality of outer supports, one of said outer supports connected to a location on said outer winding layer;

wherein one of said first or second hubs is capable of rotating to cause said coil winding to wind or unwind;

an interconnect hub capable of providing electrical connection to said coil winding.

2. The electromagnetic coil of claim 1 including an inner interconnect cable and an outer interconnect cable, both attached to said coil winding and to said interconnect hub wherein one of said inner or outer interconnect cables is capable of winding about said interconnect hub.

3. The electromagnetic coil of claim 1 wherein said interconnect hub includes a first portion and a second portion capable of rotating relative to one another and providing electrical connection to said coil winding.

4. The coil of claim 2 wherein one of said inner or outer interconnect cables is capable of winding in a second direction opposite to said coil winding first direction.

5. The coil of claim 2 wherein one of said inner or outer interconnect cables is capable of winding in a second direction equal to said coil winding first direction.

6. The coil of claim 1 wherein said inner support is capable of extending or retracting in a radial direction.

7. The coil of claim 1 wherein said outer support is capable of extending or retracting in a radial direction.

8. The coil of claim 1 wherein said inner support includes a curved surface portion.

9. The coil of claim 2 wherein both of said inner and outer interconnect cables are capable of winding about said interconnect hub.

10. The coil of claim 1 wherein said coil winding includes one or a plurality of conductors wherein said conductors are connected in series.

11. The coil of claim 1 wherein said coil winding includes one or a plurality of conductors wherein said conductors are connected in parallel.

12. An electromagnetic coil comprising a coil winding containing inner and outer winding layers wherein said coil winding is wound in a first direction;

a first hub including one or a plurality of inner supports, one of said inner supports connected to a location on said inner winding layer and is capable of extending or retracting in a radial direction;

a second hub including one or a plurality of outer supports, one of said outer supports connected to a location on said outer winding layer and is capable of extending or retracting in a radial direction;

wherein one of said first or second hubs is capable of rotating to cause said coil winding to wind or unwind;

an inner interconnect cable and an outer interconnect cable, both attached to said coil winding and to an interconnect hub wherein one of said inner or outer interconnect cables is capable of winding about said interconnect hub in a second direction that is either equal to or opposite to said first direction.

13. The coil of claim 12 wherein said inner support includes a curved surface portion.

14. The coil of claim 12 wherein both of said inner and outer interconnect cables are capable of winding about said interconnect hub.

15. The coil of claim 12 wherein said coil winding includes one or a plurality of conductors wherein said conductors are connected in series.

16. The coil of claim 12 wherein said coil winding includes one or a plurality of conductors wherein said conductors are connected in parallel.

17. A method of manufacturing a variable diameter electromagnetic coil comprising:

forming a coil winding containing inner and outer winding layers wherein said coil winding is wound in a first direction;

positioning a first hub including one or a plurality of inner supports within said coil, one of said inner supports connected to a location on said inner winding layer;

positioning a second hub within said coil including one or a plurality of outer supports, one of said outer supports connected to a location on said outer winding layer;

wherein one of said first or second hubs is capable of rotating to cause said coil winding to wind or unwind;

attaching an inner interconnect cable and an outer interconnect cable to said coil winding and to an interconnect hub wherein one of said inner or outer interconnect cables is capable of winding about said interconnect hub.

18. The method of claim 17 wherein said inner support includes a curved surface portion.

19. The method of claim 17 wherein said coil winding includes one or a plurality of conductors wherein said conductors are connected in series.

20. The method of claim 17 wherein said coil winding includes one or a plurality of conductors wherein said conductors are connected in parallel.

* * * * *